US005803399A

United States Patent [19]

Hashikawa

[11] Patent Number: 5,803,399

[45] Date of Patent: Sep. 8, 1998

[54] EXPANDABLE SHAFT

[75] Inventor: Yoshito Hashikawa, Nagasaki, Japan

[73] Assignee: Japan Development Consultants, Inc., Nagasaki, Japan

[21] Appl. No.: 910,389

[22] Filed: Aug. 13, 1997

[30] Foreign Application Priority Data

Nov. 27, 1996 [JP] Japan ..... 8-332748
Jul. 4, 1997 [JP] Japan ..... 9-195146

[51] Int. Cl.[6] ..... B65H 75/24

[52] U.S. Cl. ..... 242/576.1; 279/2.07

[58] Field of Search ..... 242/576.1, 571; 279/2.07, 2.06, 4.11; 269/48.1, 48.2

[56] References Cited

U.S. PATENT DOCUMENTS

| | | | |
|---|---|---|---|
| 3,010,671 | 11/1961 | Brown | 242/576.1 |
| 4,026,491 | 5/1977 | Bostroem . | |
| 4,050,643 | 9/1977 | Secor | 242/576.1 |
| 4,147,312 | 4/1979 | Secor et al. | 242/576.1 |
| 4,154,412 | 5/1979 | Briar et al. | 242/576.1 |
| 4,209,138 | 6/1980 | Cecchi | 242/576.1 |
| 4,218,029 | 8/1980 | Schwenzfeier et al. | 242/576.1 |
| 4,473,195 | 9/1984 | Marin . | |
| 5,375,791 | 12/1994 | Kline et al. | 242/576.1 |
| 5,509,618 | 4/1996 | Kleiman et al. | 242/571.2 |
| 5,518,203 | 5/1996 | Annaka et al. | 242/576.1 |

FOREIGN PATENT DOCUMENTS

| | | |
|---|---|---|
| 51-35458 | 10/1976 | Japan . |
| 56-136748 | 10/1981 | Japan . |
| 4-54983 | 12/1992 | Japan . |
| 5-104140 | 4/1993 | Japan . |
| 6-14814 | 4/1994 | Japan . |
| 1402012 | 8/1975 | United Kingdom . |

*Primary Examiner*—John M. Jillions
*Attorney, Agent, or Firm*—Sughrue, Mion, Zinn, Macpeak & Seas, PLLC

[57] ABSTRACT

An expandable shaft comprises: a shaft body having a central axis and an outer cylindrical surface; a fluid passageway extending along the central axis of the shaft body; fluid introducing ports radially outwardly extending and communicating with the fluid passageway; a fluid filling to the fluid passageway and the fluid introducing ports; grooves extending on the outer cylindrical surface of the shaft body in a direction of the central axis of the shaft body, wherein each groove communicates with the respective introducing ports; and long lugs slidably inserted into the grooves, wherein the long lugs are elastically returned in the grooves when a fluid pressure by the fluid is eliminated, and the long lugs are protruded from the outer cylindrical surface when the fluid pressure is applied. Thus, the long lugs are able to stroke within the limits of the difference of the angle between the sloped bottom portion of the long lugs and the sloped locking surface of the grooves.

7 Claims, 7 Drawing Sheets

EXPANDABLE SHAFT

BACKGROUND OF THE INVENTION

This invention relates to the case where, in a facility for manufacturing or processing metal, paper, and plastic film, in order to wind those materials in the form of rolls, an annular or cylindrical member such as the core of a coil or roll is wound on the outer cylindrical surface of the shaft, or the case where an annular or cylindrical member of a guide device adapted to neatly wind a processing material in the operation of winding the aforementioned coil or roll, or an annular or cylindrical member such as a separator disk used when the materials are slit and wound, or an annular or cylindrical member such as the edge of a slitter is expanded and fixed on a rotary shaft or set loosened on it, and more particularly to an expandable shaft for fixing those annular or cylindrical members on it. More particularly, the present invention relates to an expanding shaft which is so designed that its long lugs which are provided in such a manner that they are able to come in and out of the outer cylindrical surface of the shaft radially press an annular or cylindrical member mounted on the shaft, thereby to fix the annular or cylindrical member at a predetermined position. The present invention also relates to a band winding apparatus in which a wide plate is slitted as bands and the bands thus slitted are wound on the expanding shaft.

FIG. 9 shows a conventional winding equipment for winding bands 10 of a plate 22. The winding equipment has the winding apparatus 50, a tensioning machine 51, a winding-back machine 30, guide rollers 31 and a slitter machine 12. This winding equipment also has a loop pit 52 upstream the tensioning machine 51, for receiving the slack of the bands 10. Both the tensioning machine 51 and the loop pit 52 make a size of the winding equipment large and complicated. Furthermore, the winding equipment costs are high.

When, in a facility for manufacturing or processing the plate-like work, for instance, metal, paper, plastic film, etc., those materials are wound in the form of rolls, the core of a coil or roll is fixed to the rotary shaft. In this case, a guide device for neatly winding a processing material in a coil or roll winding operation, a separator disk which is used to slit and wind the work, or the edge of a slitter, is secured to the rotary shaft. In this connection, a method is known in the art that the edge of the slitter or the separator is fixedly mounted on the rotary shaft by tightening a nut with a spacer interposed between them. However, the method is disadvantageous. That is, the edge, the separator or the spacer must be removed from the shaft in order to replace the edge or the disk. This is rather trouble some. In order to overcome this difficulty, an expandable shaft called "an air shaft" is employed.

As shown in FIGS. 5(A) and 5(B), the expandable shaft is a hollow shaft 11, and an air tube filled with compressed air is inserted in the air tube in such a manner that the air tube extends in the axial direction of the shaft. The air tube is expanded or contracted by controlling the air pressure. A number of long holes which are divided into parts in the axial direction are formed in the outer cylindrical surface of the shaft at predetermined intervals in the axial direction and in the direction of circumference of the latter. Pressing pieces called "short lugs" 13 are arranged in the long holes in such a manner that the short lugs 13 are radially movable in and out of the long holes.

As the air tube inserted in the expandable shaft 11 is expanded and contracted by controlling the air pressure, the short lugs 13 are caused to come in and out of the outer cylindrical surface of the shaft 11. When the short lugs 13 are pressed outwardly by the air tube which is expanded by the air pressure, the inner cylindrical surface of the annular or cylindrical member such a ring or core mounted on the outer cylindrical surface of the expandable shaft is radially outwardly pressed; that is, the annular or cylindrical member is fixedly set on the outer cylindrical surface of the expandable shaft 11 at the predetermined position.

However, the above-described expandable shaft called "an air shaft" suffers from the following problems:

(1) The shaft is hollow so as to accommodate the air tube. The hollow shaft has a number of long holes, in which the pressing pieces called "lugs" are arranged. Hence, the shaft is rather flexible. Therefore, it is not practical to employ it as an expandable shaft which must be large in length and high in mechanical strength.

(2) When, in the case where a separator ring or the like on the outer cylindrical surface of the shaft is arranged near the ends of the short lugs, the expanding operation is carried out, then the ring is moved laterally, which may adversely affect the dimension of the annular or cylindrical member.

(3) With a number of short lugs in contact with the outer surface of the air tube in the shaft, the air tube is expanded or contracted. Therefore, the air tube of rubber is liable to be damaged, and it is often burst. When the air is discharged from the air tube, the latter is deformed, as a result of which the short lugs may drop in the hollow shaft. In this case, because of the internal structure of the shaft, it is difficult to repair the shaft at the working site; that is, it is necessary to return the shaft to the factory which has manufactured it.

(4) In combination with the above-described problems, the following problem exists with the conventional expandable shaft: The air tube uses a low air pressure. Hence, in the case of a ring to which a great external force is applied, the ring may be moved laterally.

(5) Furthermore, the shaft suffers from a difficulty that a force of holding the paper or film winding core is sometimes inadequate, or the latter may be bent.

SUMMARY OF THE INVENTION

Accordingly, an object of the invention is to eliminate the above-described difficulties accompanying a conventional expandable shaft. More specifically, an object of the invention is to provide an expandable shaft which has been improved as follows: It is not always necessary that the shaft is a hollow one. The expandable shaft is prevented from being lowered in rigidity; that is, even if the shaft is long, its middle portion will never be bent. In addition, problems due to the leakage of air are prevented. Furthermore, the annular or cylindrical member is prevented from shifting laterally or inclining. The annular or cylindrical member is accurately and fixedly held on the expandable shaft a predetermined position.

In order to achieve objects, the present invention provides an expandable shaft comprising: a shaft body having a central axis and an outer cylindrical surface; a fluid passageway extending along the central axis of the shaft body; fluid introducing ports radially outwardly extending and communicating with the fluid passageway; a fluid filling to the fluid passageway and the fluid introducing ports; grooves extending on the outer cylindrical surface of the shaft body in a direction of the central axis of the shaft body, wherein each groove communicates with the respective introducing ports; and long lugs slidably inserted into the grooves, wherein the long lugs are elastically returned in the grooves when a fluid pressure by the fluid is eliminated, and the long lugs are protruded from the outer cylindrical surface when the fluid pressure is applied.

According to another aspect of the present invention, there is provided a band winding apparatus for winding bands, comprising: an expandable shaft including, a shaft body having a central axis and an outer cylindrical surface, a fluid passageway extending along the central axis of the shaft body, fluid introducing ports radially outwardly extending and communicating with the fluid passageway, a fluid filling to the fluid passageway and the fluid introducing ports, grooves extending on the outer cylindrical surface of the shaft body in a direction of the central axis of the shaft body, wherein each groove communicates with at least one of the introducing ports and has side walls being parallel to each other and sloped locking surfaces being of a bisymmetrical trapezoid, and long lugs slidably inserted into the grooves, each of the long lugs having side walls being parallel to each other and slidably contact with the side walls of the respective grooves and a sloped bottom portion made of an elastic material, wherein an angle of the sloped bottom portion of the long lugs is smaller than an angle of the sloped locking surface of the grooves, the long lugs are elastically returned in the grooves when a fluid pressure by the fluid is eliminated, and the long lugs are protruded from the outer cylindrical surface when the fluid pressure is applied; ring members, each having an outer cylindrical surface on which the respective bands are wound and an inner cylindrical surface into which the expandable shaft is inserted.

DETAILED DESCRIPTION OF THE PREFERRED EMBODIMENTS

The invention will be more concretely described with reference to its preferred embodiment shown in the accompanying drawings.

Figure 1:
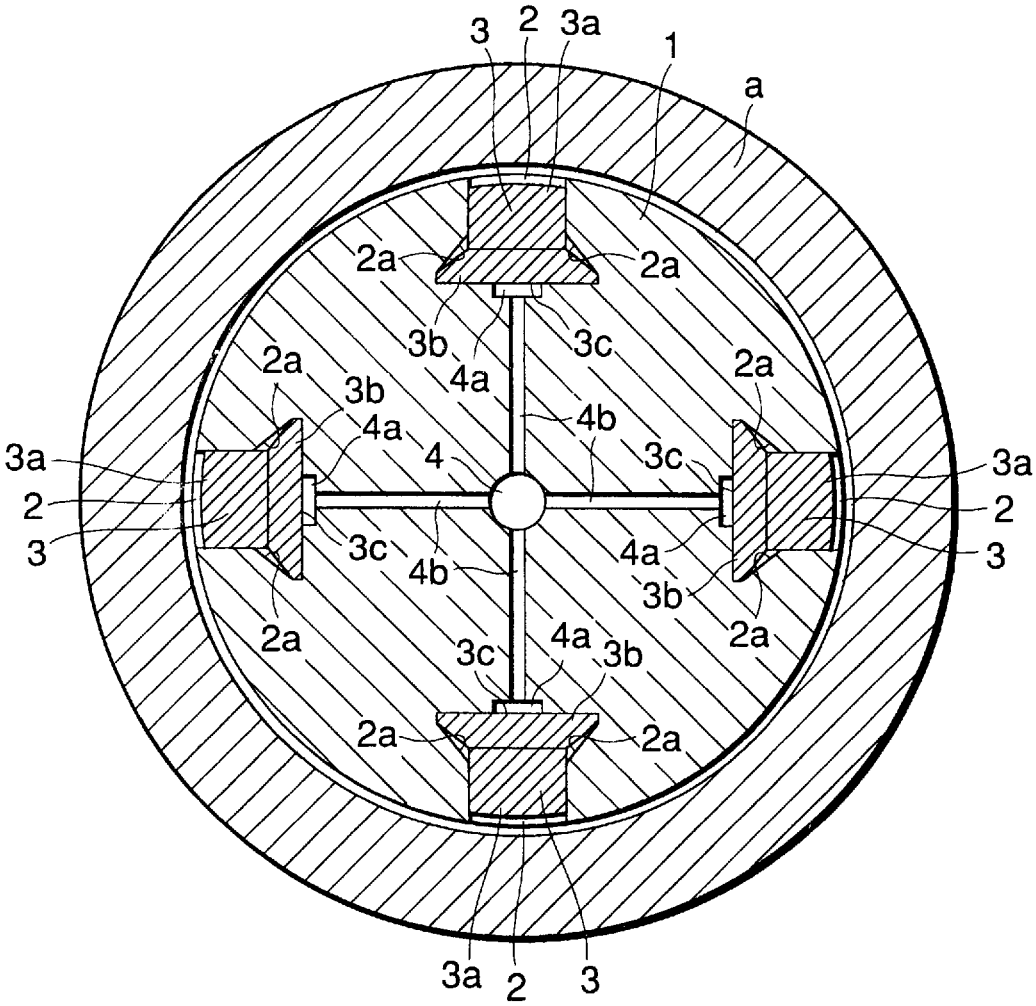
FIG. 1 is a sectional view of an expandable shaft on which an annular or cylindrical member is mounted, according to the present invention.
Figure 2:
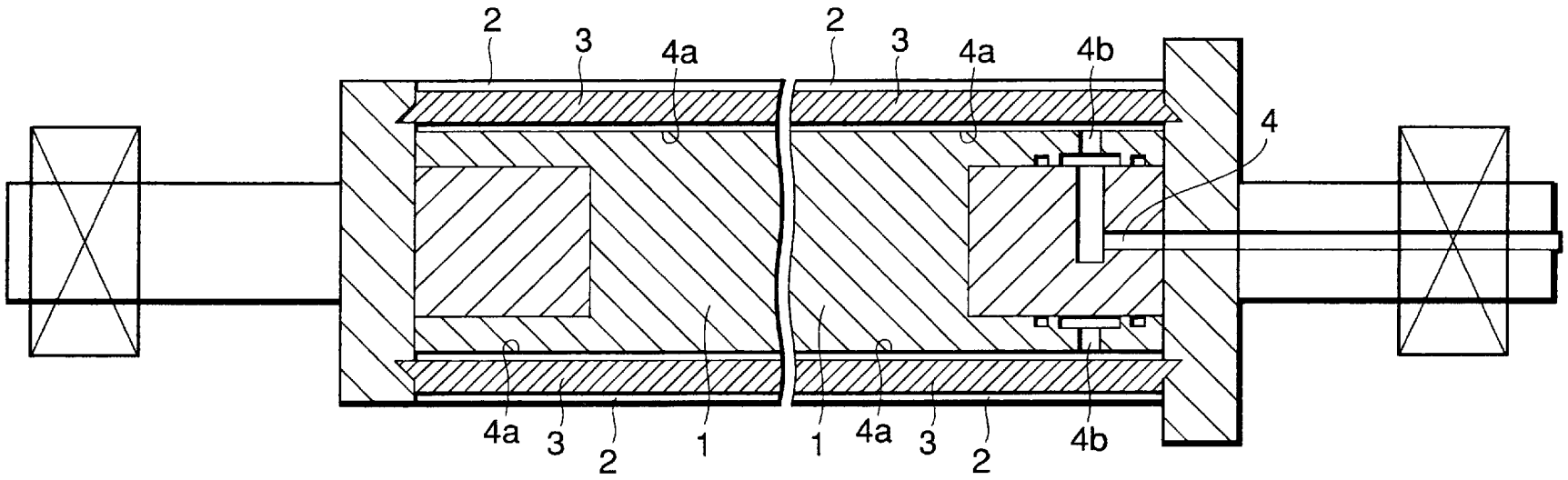
FIG. 2 is a sectional side view outlining the structure of the expandable shaft according to the invention.
Figure 3A:
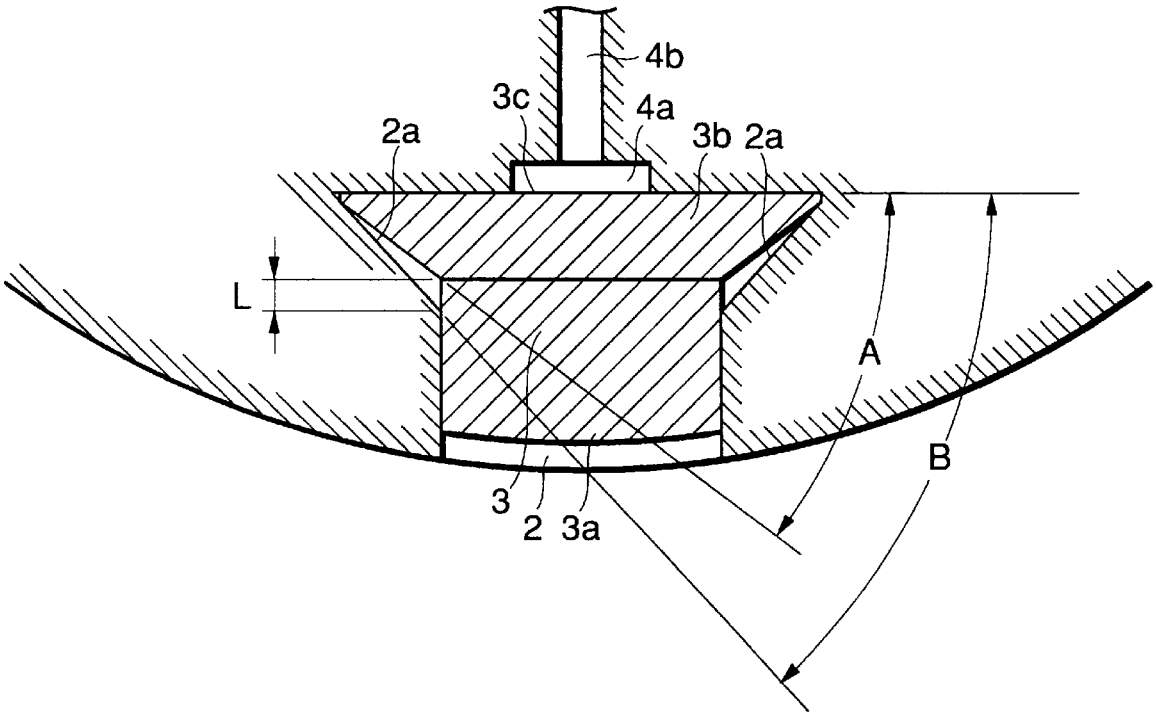
FIGS. 3(A) and 3(B) are explanatory diagram for a description of the operation of the expandable shaft according to the invention.
Figure 3B:
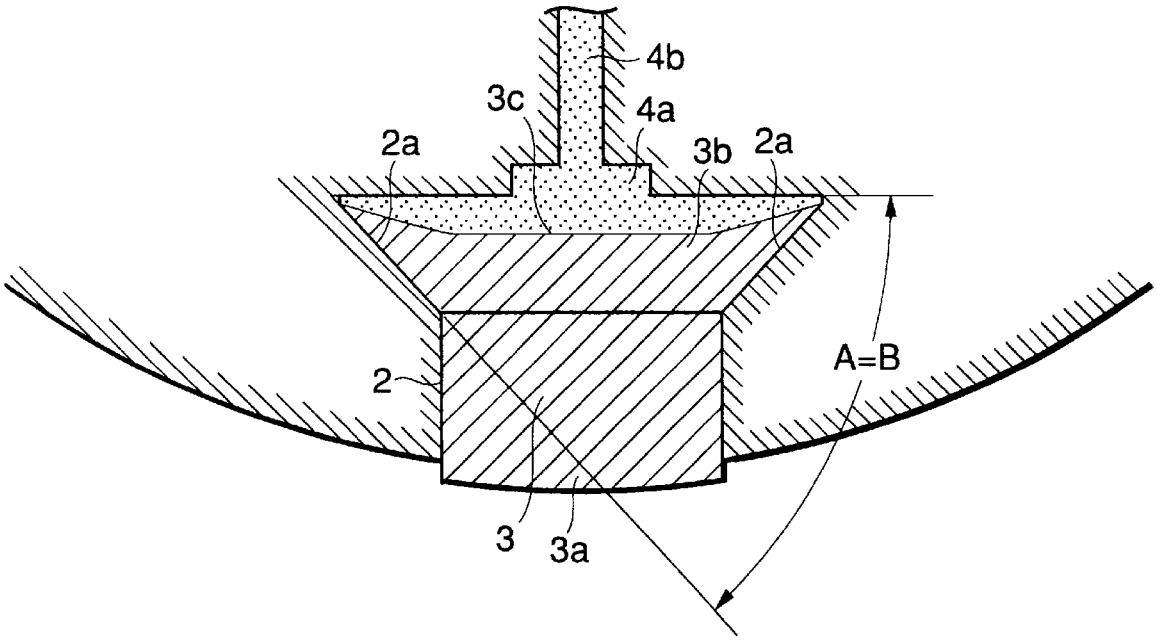
Figure 4A:
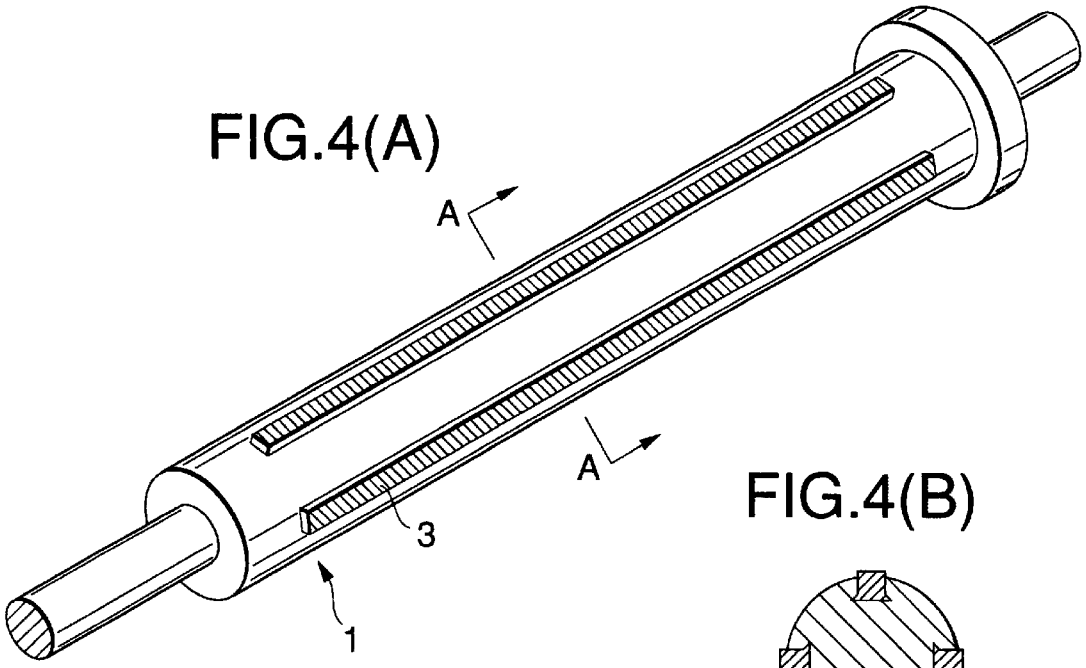
FIG. 4(A) is a perspective view of the expandable shaft according to the present invention.
Figure 4B:
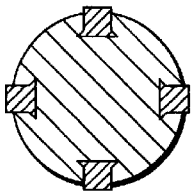
FIG. 4(B) is a cross sectional view along line A—A of FIG. 4(A)
Figure 5A:
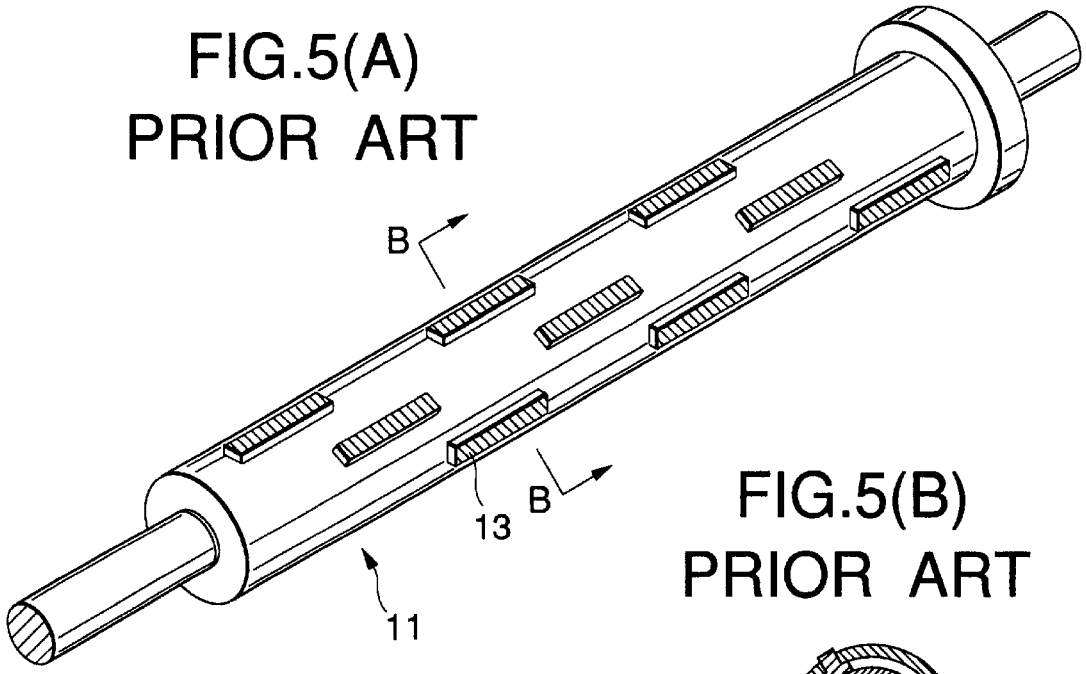
FIG.5(A) PRIOR ART
FIG. 5(A) is a perspective view of a conventional expandable shaft.
Figure 5B:
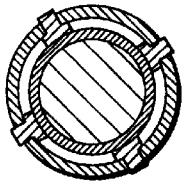
FIG.5(B) PRIOR ART
FIG. 5(B) is a cross sectional view along line B—B of FIG. 5(A)

FIG. 4 is a perspective view of an expandable shaft according to the present invention. FIG. 1 is a sectional view of the expandable shaft with an annular or cylindrical member. FIG. 2 is a sectional side view outlining the structure of the expandable shaft. FIGS. 3(A) and 3(B) are explanatory diagrams for a description of the operation of the expandable shaft.

In those Figures, reference numeral 1 designates the expandable shaft according to the invention. The expandable shaft 1 has grooves 2 in the outer cylindrical surface at equal intervals, and long lugs 3 which are elongated in an axial direction of the shaft. The long lugs 3 are engaged with the grooves 2 in such a manner that they are movable radially outwardly and inwardly. That is, the long lugs 3 radially press the inner cylindrical surface of an annular or cylindrical member a such as a ring which is fitted on the outer cylindrical surface of the shaft 1, thereby to hold the annular or cylindrical member a on the outer cylindrical surface of the shaft at a predetermined position.

The shaft 1 is for instance circular in section, and the grooves 2 are formed in the outer cylindrical surface of the shaft 1 at equal intervals in such a manner that the grooves 2 open in the outer cylindrical surface of the shaft 1. The grooves 2 extend in the axial direction of the shaft 1. The axial length of each of the grooves 2 corresponds to the whole length of the shaft 1 except both end portions thereof.

Each of the grooves 2 extends from the outer cylindrical surface of the shaft 1 towards the center of the shaft 1, and it is in the form of a recess which opens in the outer cylindrical surface in such a manner that its bottom is wider than its opening. Each of the grooves 2 has inside surfaces as viewed in a right-to-left direction perpendicular to the axial direction.

In the opening portion of each of the grooves, which are formed in the outer cylindrical surface of the shaft 1, the right and left inner side surfaces extend towards the center of the shaft and are in parallel with each other. Those right and left inner side surfaces of the groove 2 are slid on the right and left side surface of the respective long lug 3.

The bottom portions of the right and left inner surfaces of each of the grooves 2 have sloped locking surfaces 2*a* which are sloped towards the bottom while increasing the distance between them. The sloped bottom portions 3*b* (described later), which are the bottom portions of the long lugs 3, are brought into close contact with the sloped locking surfaces 2*a* while being elastically deformed. In each of the grooves 2, the bottom portion is larger in the distance between the right and left side surfaces than the opening portion. It should be noted that the right and left sloped locking surfaces 2*a* are of a bisymmetrical trapezoid.

As was described above, in each of the grooves 2, the bottom portion is large in the distance between the right and left side surfaces than the opening portion. The long lug 3 which is long in the direction of axis is fitted in each of the grooves 2 in such a manner that it is movable radially outwardly and inwardly. Each of the long lugs 3 functions as follows: The long lug 3 has a top end portion 3*a* which protrudes from the outer cylindrical surface of the shaft 1 through the opening of the groove by a fluid pressure, so as to press the inner cylindrical surface of an annular or cylindrical member a such as a ring mounted on the outer cylindrical surface of the shaft 1, thereby to fixedly hold it at a predetermined position.

In each of the long lugs 3, the top end portion 3*a* is linear and has right and left side surfaces which are in parallel with each other, and the rear end portion is the aforementioned sloped bottom portion 3*b* trapezoid in section, having sloped surfaces 3*b* whose distance is larger towards the central axis of the shaft 1. Each of the long lugs 3 may be formed as follows: The top end portion 3*a* and the sloped bottom portion 3*b* are formed as one unit by molding, or the top end portion 3*a* and the sloped bottom portion 3*b* are separately made of different materials, and then combined together. The sloped bottom portion 3*b* is made of an elastic material; that is, it is elastically deformed by the fluid pressure so that it is brought into close contact with the sloped locking surfaces 2*a* of the groove 2. As the sloped bottom portion 3*b* is elastically deformed, and the long lug 3 is brought into close contact with the sloped locking surfaces 2*a* of the grooves in the above-described manner, the fluid is completely sealed, which presses the rear end face 3*c* of the sloped bottom portion 3*b*.

The rear end portion of each of the long lugs 3, namely, the sloped bottom portion 3*b* is in the form of a bisymmetrical trapezoid. The angle A at both ends of the bottom side of the sloped bottom portion 3*b* is slightly smaller than the angle B at both ends of a trapezoid formed by the sloped locking surfaces 2*a* of the groove 2. Hence, within a gap L based on the difference between the angles A and B, the long lug 3 strokes so that the top end portion 3*a* is moved in and out of the opening of the groove 2. That is, when the fluid pressure is eliminated, and the long lug 3 is hidden in the groove 2, the front end of the sloped bottom portion 3*b* forms the gaps L with the sloped locking surfaces 2*a* of the groove 2, while the rear end of the sloped bottom portion 3*b* is in closed contact with the sloped locking. surfaces 2*a* of the groove 2, thus preventing the leakage of the fluid. Upon injection of the fluid, depending on the pressure of the fluid, the sloped bottom portion 3*b* is strongly pushed against the sloped locking surfaces 2*a* of the groove, more positively preventing the leakage of the fluid.

When the fluid is injected to press the rear end face 3*c* of the sloped bottom portion 3*b* of the long lug 3 towards the opening of the groove 2, the long lug 3 protrudes until it abuts against the inner cylindrical surface of the annular or cylindrical member a, thus holding the member a. When the fluid is removed, the sloped bottom portion 3*b* is restored by its own elasticity, so that the long lug 3 is retracted into the expandable shaft 1. The fluid may be oil, water, air, and so forth.

Each of the grooves 2 of the shaft 1 has a fluid groove 4*a* in the bottom which is extended longitudinally of the groove 2. On the other hand, the shaft 1 has a fluid passageway 4 which is extended along the central axis of the shaft 1. The fluid passageway 4 has fluid introducing ports 4*b* at one end which are connected to the fluid grooves 4*a* of the grooves 2. More specifically, the fluid introducing ports 4*b* are radially outwardly extended from one end of the fluid passageway 4 (extending along the central axis) to the fluid grooves 4*a* of the grooves 2, respectively. The fluid passageway 4 is extended to one end of the expandable shaft 1, where it is connected to a fluid path (not shown). The fluid path (not shown) is connected, for instance, through a three-way valve to a pressure tank provided outside of the shaft 1. On the other hand, a fluid pressure pump or an air compressor for supplying the fluid from the pressure tank to the expandable shaft 1 is provided. With the fluid pressure held in the pressure tank, the three-way valve is opened and closed to expand and contract the expandable shaft 1.

The fluid grooves 4*a* of the grooves 2 are communicated through the fluid introducing ports 4*b* with the fluid passageway 4. The fluids in the fluid grooves 4*a* at the bottoms of the grooves 2 are equal in pressure, being communicated with one another through the fluid introducing ports 4*b* and the fluid passageway 4; that is, the rear end faces 3*c* of the sloped bottom portions 3*b* of the long lugs are pressed under one and the same fluid pressure.

The operation of the expandable shaft designed as described above will be described.

An annular or cylindrical member a such as a ring is mounted on the expandable shaft 1 at a predetermined position. In this case, the top end portions 3*a* of the long lugs 3 of the shaft 1 are not protruded from the outer cylindrical surface of the shaft 1 yet.

At that time, the inside diameter of the annular or cylindrical member a mounted on the shaft 1 is slightly larger that the outside diameter of the shaft 1, and the top end portions of the long lugs 3 are not protruded from the outer cylindrical surface of the shaft 1. Hence, the annular or cylindrical member a can be readily slid to the predetermined position.

After the annular or cylindrical member a has been mounted on the shaft 1 at the predetermined position in the above-described manner, a fluid pressure pump or an air compressor is operated which is provided outside the expandable shaft 1. As the fluid pressure pump or the air compressor is operated, the fluid is supplied, under pressure, from the fluid tank to the fluid path. The fluid thus supplied is supplied through the fluid path to the fluid passageway 4, and then through the fluid introducing ports 4*b* to the fluid grooves 4*a* at the bottoms of the grooves 2.

When the fluid is supplied to the fluid grooves 4*a* at the bottoms of the grooves 2, the rear end faces 3*c* of the slope bottom portions 3*b* of the long lugs 3 are pressed by the fluid at one and the same pressure. As a result, the long lugs 3 start to slide towards the openings of the grooves while being in close contact with the side surfaces of the grooves 2.

In this case, both ends of the rear end face of each of the sloped bottom portions 3*b* is in close contact with the rear ends of the respective sloped locking surfaces 2*a* defining a trapezoid, and, as was described before, the angle B of the front part of the sloped locking surface 2*a* is larger than the angle A of the front part of the sloped bottom portion, and the gap L is present between the front part of the sloped bottom portion 3*b* and the front part of the sloped locking surface 2*a* (cf. FIG. 3(A)). Hence, the central region of the rear end face 3*c* of the sloped bottom portion 3 which is pressed by the fluid is deformed arcuate, so that the front part of the sloped bottom portion 3*b* is brought into close contact with the front parts of the sloped locking surfaces 2*a*.

When the central region of the rear end face 3*c* of the sloped bottom portion 3*b* is deformed arcuate, the front face of the sloped bottom portion 3*b* which is elastically deformed presses the long lug, as a whole, towards the opening of the groove 2, so that the top end portion 3*a* of the long lug 3 is protruded from the opening of the groove 2.

The top end portion 3*a* of the long lug 3, being moved towards the opening of the groove 2, is protruded from the opening of the groove 2, thus being brought into contact with the inner cylindrical surface of the annular or cylindrical member a which has been mounted on the outer cylindrical surface of the expandable shaft 1.

When the fluid pressure pump is operated to increase the fluid pressure, the front part of the sloped bottom portion is deformed, thus being completely brought into close contact with the front parts of the sloped locking surfaces 2*a*; that is, the inclination angle A of the front region of the sloped bottom portion becomes equal to the inclination angle B of the front part of the sloped locking surface 2*a* (cf. FIG. 3(B)), which positively prevents the leakage of the fluid through the gap between the sloped bottom portion 3*b* and the sloped locking surface 2*a*.

The top end portions 3*a* of the long lugs 3 are further protruded from the grooves 2, to radially outwardly press the inner cylindrical surface of the annular or cylindrical member, thus fixedly holding the annular or cylindrical member on the expandable shaft 1 at the predetermined position.

In this case, the lugs 3 extend in the direction of axis of the expandable shaft as was described before. Hence, the long lugs 3 of the invention, unlike the conventional short lugs, are free from the difficulty that the lugs abut against the end of the annular or cylindrical member a to shift the member a laterally.

Figure 6:
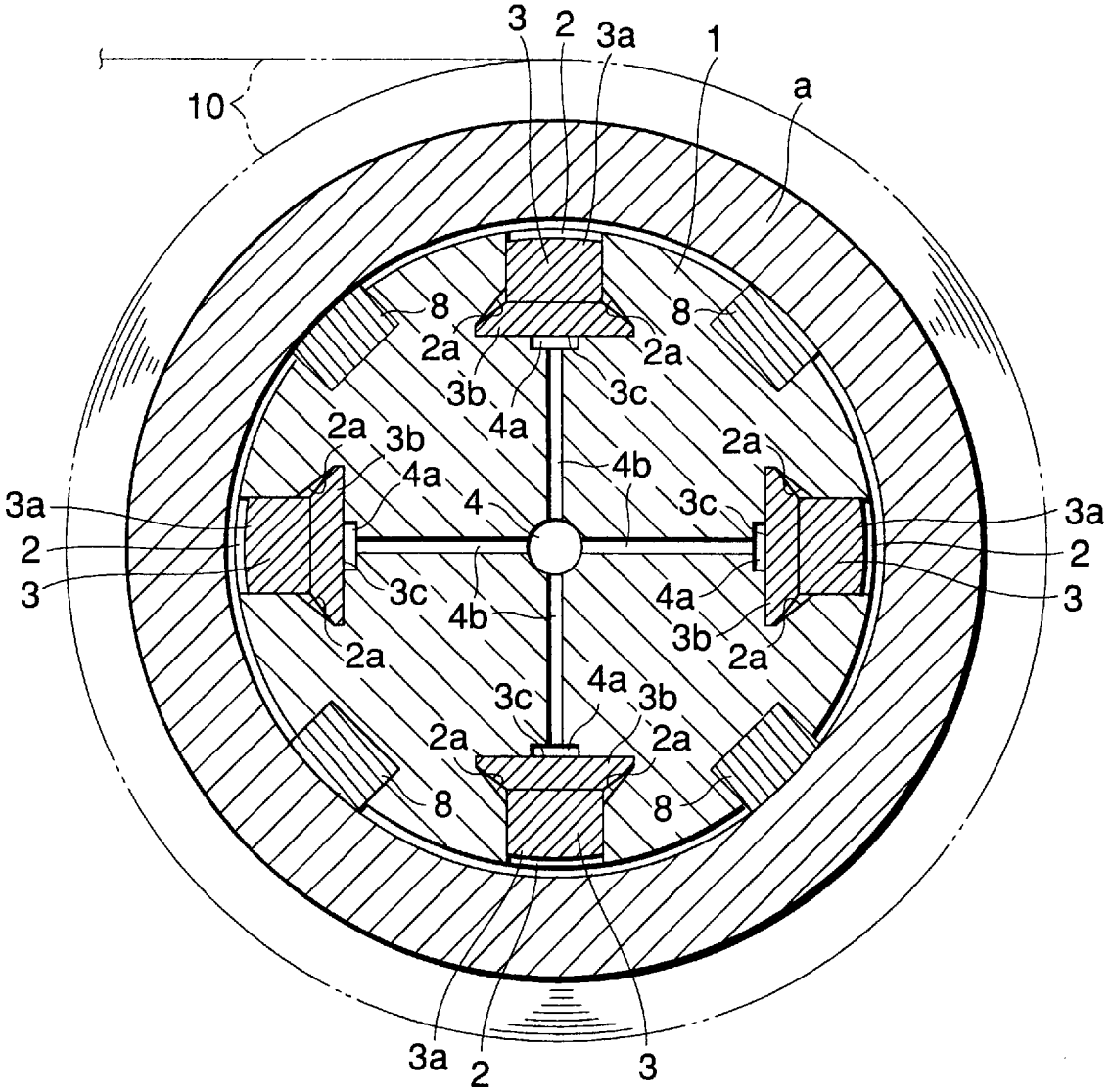
FIG. 6 is a sectional view of another expandable shaft on which ring members are mounted, according to the present invention.

FIG. 6 shows another expandable shaft 1 with ring members (annular or cylindrical members) a for winding bands 10 thereon.

In this embodiment, the same reference numerals are assigned to the corresponding structures with the first embodiment. The expandable shaft 1 of the second embodiment is similar to the first embodiment. One of differences is to provide fixing members 8 with the expandable shaft 1 of this embodiment. The fixing members 8 are attached to the outer cylindrical portion of the expandable shaft 1 with which the inner cylindrical surface of the ring members are in contact. The fixing members 8, which are provided for the purpose of keeping a rotational center of the ring members, are plugged at respective grooves extending along the axis of the expandable shaft 1. The fixing members 8 are made of, for instance, frictional wear resist plastics.

Figure 7:
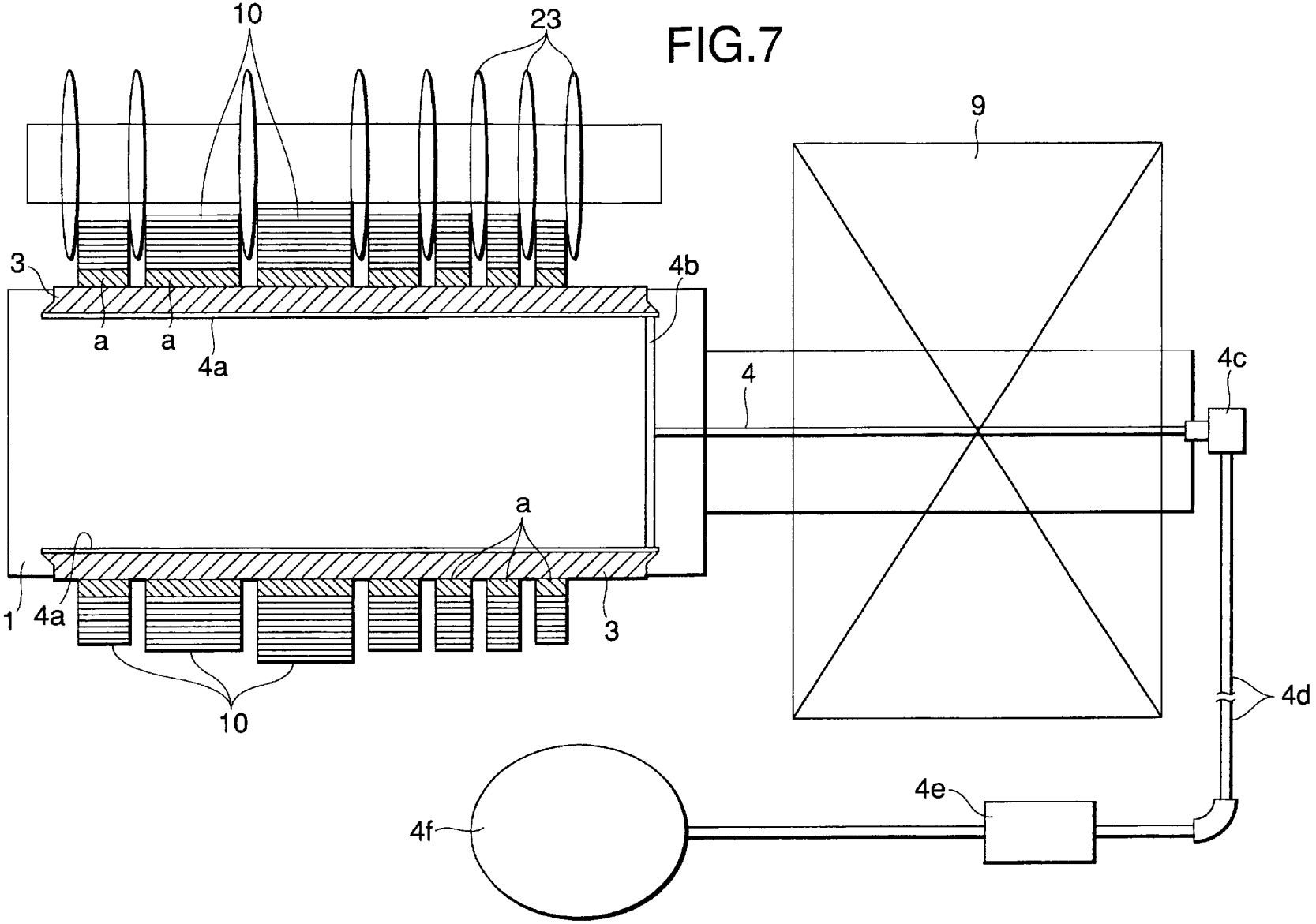
FIG. 7 is a sectional view of a band winding apparatus using the expandable shaft according to the invention.
Figure 8:
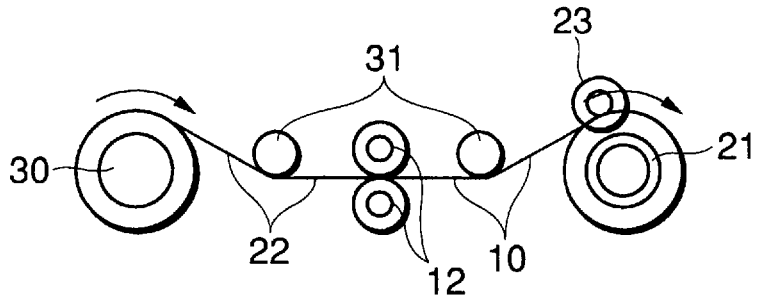
FIG. 8 shows a winding equipment using the band winding apparatus according to the invention.
Figure 9:
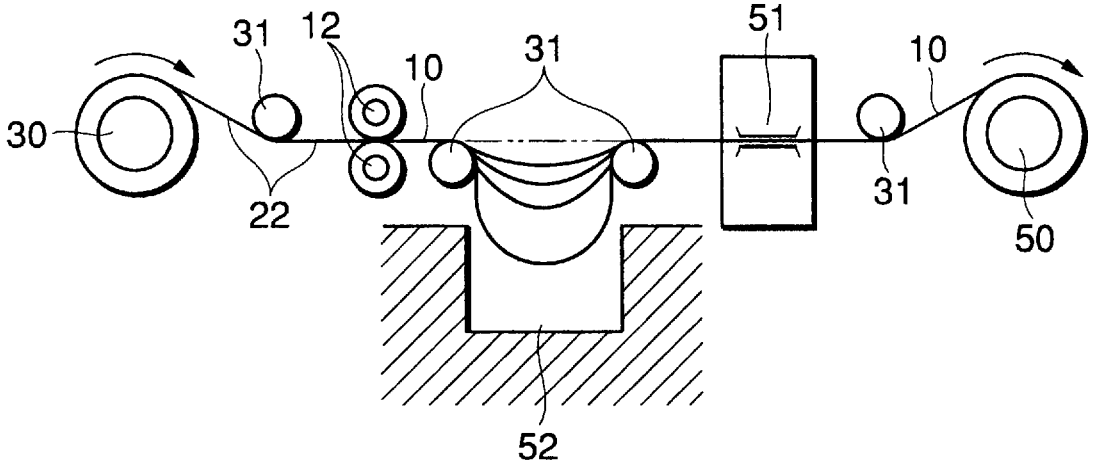
FIG. 9 show a conventional winding equipment.

FIG. 7 is a sectional view of a band winding apparatus using the expandable shaft according to the invention. FIG. 8 shows a winding equipment using the band winding apparatus according to the invention. The winding equipment for winding bands 10 of plate 22 has the winding apparatus 21 with the expandable shaft 1, a winding-back machine 30, guide rollers 31, sliters 12, and an auto-receding guide 23. The auto-receding guide 23 can get alignment of side edge of each bands 10 during winding. It is apparent from the Figures that the winding equipment using the band winding apparatus of the present invention becomes small and compact comparing with the conventional one because either the loop pit or the tensioning machine is not necessary for the winding equipment.

The expandable shaft draws the wide plate of an uncoiler, and winds up the bands fed from the slitters without becoming loose. The tension for winding is given by a braking device provided with the uncoiler, or a separate braking device.

While there has been described in connection with the preferred embodiment of the invention, it will be obvious to those skilled in the art that various changes and modifications may be made therein without departing from the invention.

As is apparent from the above description, according to the expandable shaft of the invention, unlike the conventional one, it is not always necessary that the shaft is a hollow one because no air tube is inserted therein, and accordingly even if the shaft is long, it is high in bending rigidity; that is, it is not bent at the middle. Accordingly, the expandable shaft of the invention is free from the difficulty that the shaft is rotated with its middle portion bent; that is, it is free from the difficulty that the shaft is eccentrically turned.

In the expandable shaft of the invention, unlike the conventional one, no air tube is inserted in it. Hence, the shaft is free from the difficulty that the air tube is broken and the leakage of air occurs. When the long lugs are pressed by the fluid pressure, the sloped bottom portions are elastically deformed, thus being brought into close contact with the inner side surfaces which are each sloped in such a manner that the distance between the inner side surfaces are larger towards the bottom of the groove. This feature positively prevents the leakage of the high pressure fluid through the gap between the groove and the sloped bottom portion; that is, the occurrence of troubles due to the leakage of fluid can be positively prevented.

The long lugs are elongated in the axial direction of the expandable shaft. Hence, the shaft of the invention, unlike the conventional one, is free from the difficulty that, when a plurality of lugs short in the axial direction of the shaft press the annular or cylindrical member, the ends of the short lugs slightly shift the annular or cylindrical member laterally or slightly incline it, so that the annular or cylindrical member is not held exactly at the predetermined position. Thus, the annular or cylindrical member can be held on the expandable shaft at the predetermined position.

The expandable shaft of the invention is a substantially solid shaft. Hence, it is high in mechanical strength and less bendable. Therefore, it may be realized as a long one. Furthermore, it employs the long lugs which are extended in the direction of axis of the shaft. Hence, the long lugs are sufficiently brought into close contact with the annular or cylindrical member mounted on the shaft. The long lugs are not of inner pressure type tube but bar-shaped lugs, and therefore they are long in service life, and can be replaced at the working site. The shaft of the invention, unlike the tube type expandable shaft, is free from the difficulty that the air tube bursts. Furthermore, a high pressure fluid can be applied to the long lugs; that is, with the long lugs, a great holding force can be produced.

What is claimed is:

1. An expandable shaft comprising:

a shaft body having a central axis and an outer cylindrical surface;

a fluid passageway extending along the central axis of the shaft body;

fluid introducing ports radially outwardly extending and communicating with the fluid passageway;

a fluid filling to the fluid passageway and the fluid introducing ports;

grooves extending on the outer cylindrical surface of the shaft body in a direction of the central axis of the shaft body, wherein each groove communicates with at least one of the introducing ports and has side walls being parallel to each other and sloped locking surfaces being of a bisymmetrical trapezoid; and long lugs slidably inserted into the grooves, each of the long lugs having side walls being parallel to each other and slidably contacting with the side walls of the respective grooves and an integral, sloped bottom portion made of an elastic material, wherein an angle of the sloped bottom portion of the long lugs is smaller than an angle of the sloped locking surface of the grooves, the long lugs are elastically returned in the grooves when a fluid pressure by the fluid is eliminated, and the long lugs are protruded from the outer cylindrical surface when the fluid pressure is applied.

2. The expandable shaft according to claim 1, wherein the fluid is either one of oil, water and air.

3. The expandable shaft according to claim 1, further comprising:

fluid groove portions, each formed between the respective groove and the introducing ports communicating therewith, wherein a width of the fluid groove portions is narrower than a width of the grooves.

4. A band winding apparatus for winding bands, comprising:

an expandable shaft comprising, a shaft body having a central axis and an outer cylindrical surface, a fluid passageway extending along the central axis of the shaft body, fluid introducing ports radially outwardly extending and communicating with the fluid passageway, a fluid filling to the fluid passageway and the fluid introducing ports, grooves extending on the outer cylindrical surface of the shaft body in a direction of the central axis of the shaft body, wherein each groove communicates with at least one of the introducing ports and has side walls being parallel to each other and sloped locking surfaces being of a bisymmetrical trapezoid, and long lugs slidably inserted into the grooves, each of the long lugs having side walls being parallel to each other and slidably contacting with the side walls of the respective grooves and an integral, sloped bottom portion made of an elastic material, wherein an angle of the sloped bottom portion of the long lugs is smaller than an angle of the sloped locking surface of the grooves, the long lugs are elastically returned in the grooves when a fluid pressure by the fluid is eliminated, and the long lugs are protruded from the outer cylindrical surface when the fluid pressure is applied;

ring members, each having an outer cylindrical surface on which the respective bands are wound and an inner cylindrical surface into which the expandable shaft is inserted.

5. The band winding apparatus according to claim 4, wherein the fluid is either one of oil, water and air.

6. The band winding apparatus according to claim 4, wherein the expandable shaft further comprising fluid groove portions, each formed between the respective groove and the introducing ports communicating therewith, wherein a width of the fluid groove portions is narrower than a width of the grooves.

7. The band winding apparatus according to claim 4, further comprising:

fixing members attached to the outer cylindrical surface of the shaft body of the expandable shaft with which the inner cylindrical surface of the ring members contact.

* * * * *